US009194547B2

(12) United States Patent
Ancona et al.

(10) Patent No.: US 9,194,547 B2
(45) Date of Patent: Nov. 24, 2015

(54) FLASHLIGHT WITH INTEGRATED CLIP IN HANDLE

(75) Inventors: Bruce Ancona, New York, NY (US); Louis F. Henry, Scarsdale, NY (US); Jacob Wilson, New York, NY (US)

(73) Assignee: Blackbeam LLC, New York, NY (US)

( * ) Notice: Subject to any disclaimer, the term of this patent is extended or adjusted under 35 U.S.C. 154(b) by 0 days.

(21) Appl. No.: 13/544,521

(22) Filed: Jul. 9, 2012

(65) Prior Publication Data

US 2014/0009921 A1 Jan. 9, 2014

(51) Int. Cl.

| | |
|---|---|
| ***F21L 4/04*** | (2006.01) |
| ***F21L 4/00*** | (2006.01) |
| ***F21V 21/088*** | (2006.01) |
| ***F21V 21/30*** | (2006.01) |
| *F21Y 101/02* | (2006.01) |

(52) U.S. Cl.

CPC ..... *F21L 4/005* (2013.01); *F21V 21/0885* (2013.01); *F21V 21/30* (2013.01); *F21Y 2101/02* (2013.01)

(58) Field of Classification Search

CPC ..... G03B 21/16

See application file for complete search history.

(56) References Cited

U.S. PATENT DOCUMENTS

| | | | | |
|---|---|---|---|---|
| 1,606,219 | A | | 11/1926 | Havens |
| 4,399,498 | A | | 8/1983 | Bacevius |
| 4,533,982 | A | | 8/1985 | Kozar |
| 4,654,764 | A | | 3/1987 | Hsiao |
| D324,110 | S | | 2/1992 | Yuen |
| 5,101,333 | A | | 3/1992 | Glassford |
| 5,448,463 | A | | 9/1995 | Leen |
| D374,100 | S | * | 9/1996 | Chen ..... D26/60 |
| D376,865 | S | * | 12/1996 | Chan ..... D26/60 |
| D378,434 | S | | 3/1997 | Petterson et al. |
| D404,839 | S | | 1/1999 | Petterson et al. |
| D410,557 | S | | 6/1999 | Petterson et al. |
| 5,993,022 | A | | 11/1999 | Neyer et al. |
| 6,012,827 | A | | 1/2000 | Caplan et al. |
| 6,022,119 | A | * | 2/2000 | Booty, Jr. ..... 362/98 |
| D428,175 | S | | 7/2000 | Lynch et al. |
| 6,176,592 | B1 | | 1/2001 | Kovacik et al. |
| 6,457,841 | B1 | | 10/2002 | Lynch et al. |
| D467,375 | S | | 12/2002 | Lynch et al. |
| 6,575,587 | B2 | | 6/2003 | Cramer et al. |
| 6,585,400 | B2 | | 7/2003 | Leen |
| D496,483 | S | | 9/2004 | Christianson |
| 6,802,623 | B1 | | 10/2004 | Hsu et al. |
| 6,905,223 | B2 | | 6/2005 | Halasz |
| 6,913,370 | B2 | | 7/2005 | Ping |
| 7,011,423 | B2 | | 3/2006 | Chen |
| 7,040,783 | B1 | | 5/2006 | Christianson |

(Continued)

FOREIGN PATENT DOCUMENTS

| | | |
|---|---|---|
| CN | 1645417 A | 7/2005 |

OTHER PUBLICATIONS

International Search Report and Written Opinion dated Jul. 7, 2009 for International Patent Application No. PCT/US2009/042830.

(Continued)

*Primary Examiner* — Donald Raleigh

(74) *Attorney, Agent, or Firm* — Ohlandt, Greeley, Ruggiero & Perle, L.L.P.

(57) ABSTRACT

A flashlight having a handle with a clip or clamp integrated therein, so that the flashlight can be used in either hands-free or in a portable mode. A battery compartment is disposed within the head.

19 Claims, 7 Drawing Sheets

(56) References Cited

U.S. PATENT DOCUMENTS

| | | | | |
|---|---|---|---|---|
| 7,063,435 | B2 | 6/2006 | Dallas et al. | |
| 7,111,965 | B2 | 9/2006 | Hsu | |
| 7,172,310 | B2 | 2/2007 | Hsu | |
| 7,175,318 | B2 * | 2/2007 | Booty, Jr. | 362/396 |
| D541,965 | S * | 5/2007 | Shiu | D26/60 |
| D542,450 | S | 5/2007 | Shiu | |
| 7,222,996 | B2 | 5/2007 | Lin | |
| D554,783 | S | 11/2007 | Shiu | |
| 7,318,657 | B2 | 1/2008 | Booty | |
| 7,357,540 | B2 | 4/2008 | Booty | |
| 7,390,105 | B2 | 6/2008 | Nelson et al. | |
| 7,410,272 | B2 | 8/2008 | Halasz | |
| 7,481,554 | B2 | 1/2009 | Anderson et al. | |
| 7,513,662 | B2 | 4/2009 | Parker et al. | |
| 7,540,623 | B2 | 6/2009 | Petzl et al. | |
| 7,572,024 | B2 | 8/2009 | Ko et al. | |
| D605,795 | S | 12/2009 | Baker et al. | |
| 7,850,329 | B2 | 12/2010 | Henry et al. | |
| 2003/0231491 | A1 * | 12/2003 | Shih | 362/199 |
| 2005/0105286 | A1 | 5/2005 | Dallas et al. | |
| 2007/0076410 | A1 | 4/2007 | Halasz | |
| 2008/0055888 | A1 * | 3/2008 | Sharrah et al. | 362/106 |
| 2009/0122562 | A1 | 5/2009 | Lee | |
| 2009/0154161 | A1 | 6/2009 | Parker et al. | |
| 2010/0091483 | A1 | 4/2010 | Henry et al. | |
| 2010/0277899 | A1 * | 11/2010 | Peak | 362/183 |
| 2012/0327644 | A1 * | 12/2012 | Woods | 362/191 |

OTHER PUBLICATIONS

Extended European Search Report dated Apr. 26, 2011 for European Patent Application No. 09743456.7.

English translation of Chinese Office Action dated Jul. 12, 2010 for Chinese Patent Application No. 200810215919.7.

Canadian Office Action dated Jul. 31, 2014 from corresponding Canadian Application No. 2,820,175, 2 pages.

* cited by examiner

FLASHLIGHT WITH INTEGRATED CLIP IN HANDLE

BACKGROUND OF THE DISCLOSURE

1. Field of the Disclosure

The present disclosure relates to flashlights having handles or gripping surfaces with a clip or clamp integrated therein.

2. Background

There is a significant need among users of flashlights to have some sort of "hands-free" capability, so that the user can have both hands available to work on a task while the flashlight illuminates a work space. Some currently available flashlights, however, require additional bulky mechanisms that need to be affixed to the flashlight, and take up a lot of space, to provide this utility. In addition, other currently available flashlights that can illuminate a space and allow for hands-free operation by a user are not portable, and can not be easily manipulated or carried around by the user. There are no flashlights available that can provide both capabilities at the same time.

Accordingly, there is a need for a flashlight that can provide hands-free operation for a user, while simultaneously being easily manipulated or portable.

SUMMARY OF THE DISCLOSURE

The present disclosure overcomes these and other disadvantages of the flashlights of the prior art by providing a novel illumination device, such as a flashlight, that integrates a clamp or clip into a handle or gripping portion of the device. This allows the flashlight to be used in either hands-free or portable modes.

Thus, in one embodiment, the present disclosure provides an illumination device. The illumination device comprises a head comprising a light source, a support member, wherein the head is connected to the support member, a clip having one end connected to the support member, and an opposite end having a gripping portion, and a battery compartment within the head.

In another embodiment, the present disclosure provides an illumination device, comprising a head comprising a light-emitting portion and a battery compartment and a handle rotatably connected to the head. The handle comprises a clip integrally formed therein.

In any of the embodiments of the present disclosure, the head may have a cylindrical shape with a diameter that tapers from one end to the other. The head may also have a removable rim, so that a user can open up the head to replace batteries therein. The rim can be connected to the head at an end opposite the end of the head that is connected to the clip or handle.

Figure 1:
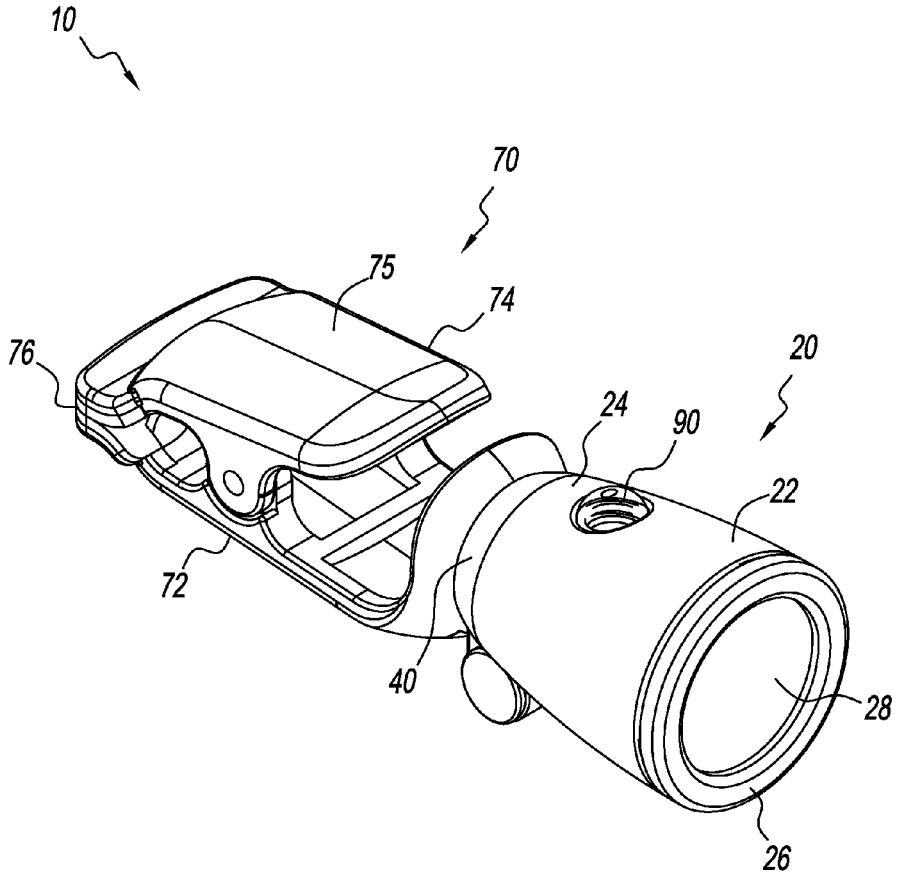
FIG. 1 is a top, perspective view of the flashlight of the present disclosure.
Figure 2:
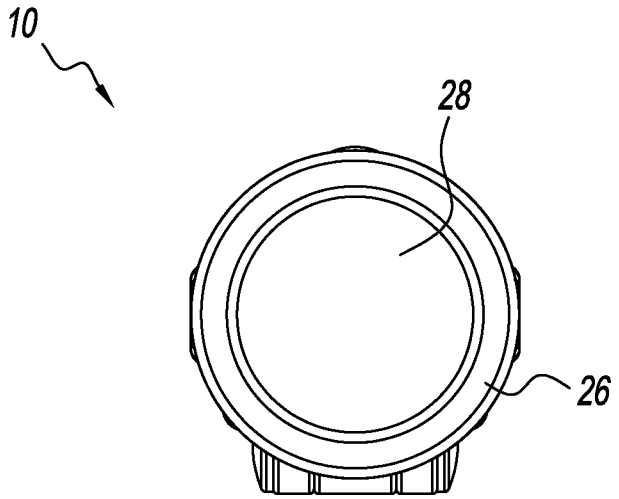
FIG. 2 is a front view of the flashlight of FIG. 1.
Figure 3:
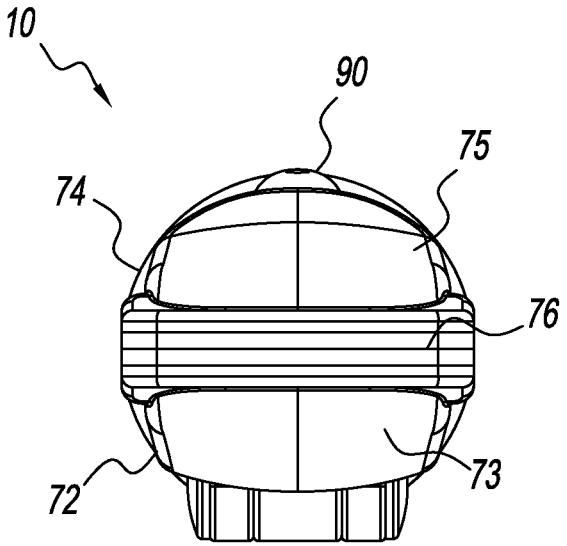
FIG. 3 is a rear view of the flashlight of FIG. 1.
Figure 4:
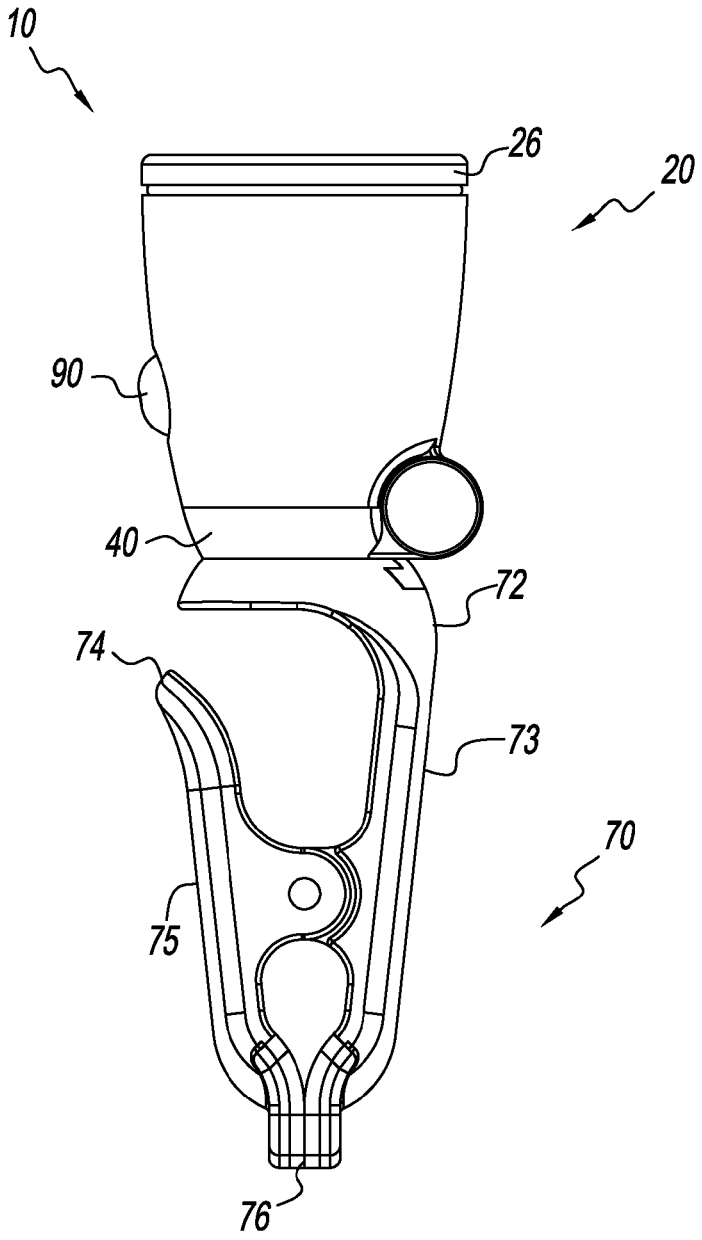
FIG. 4 is a first, side view of the flashlight of FIG. 1.
Figure 5:
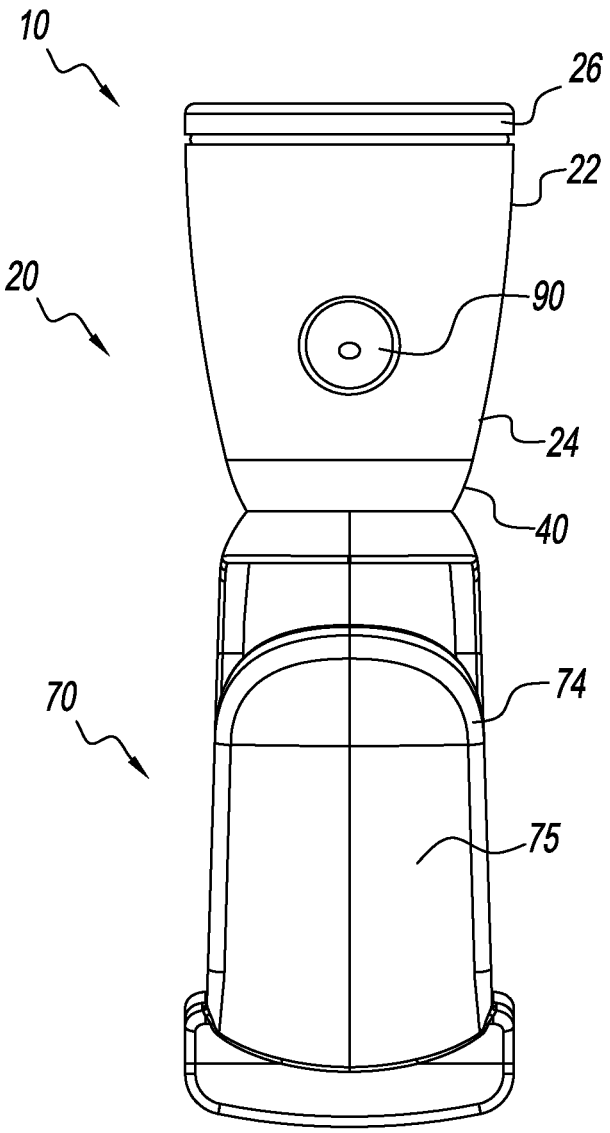
FIG. 5 is a top view of the flashlight of FIG. 1.
Figure 6:
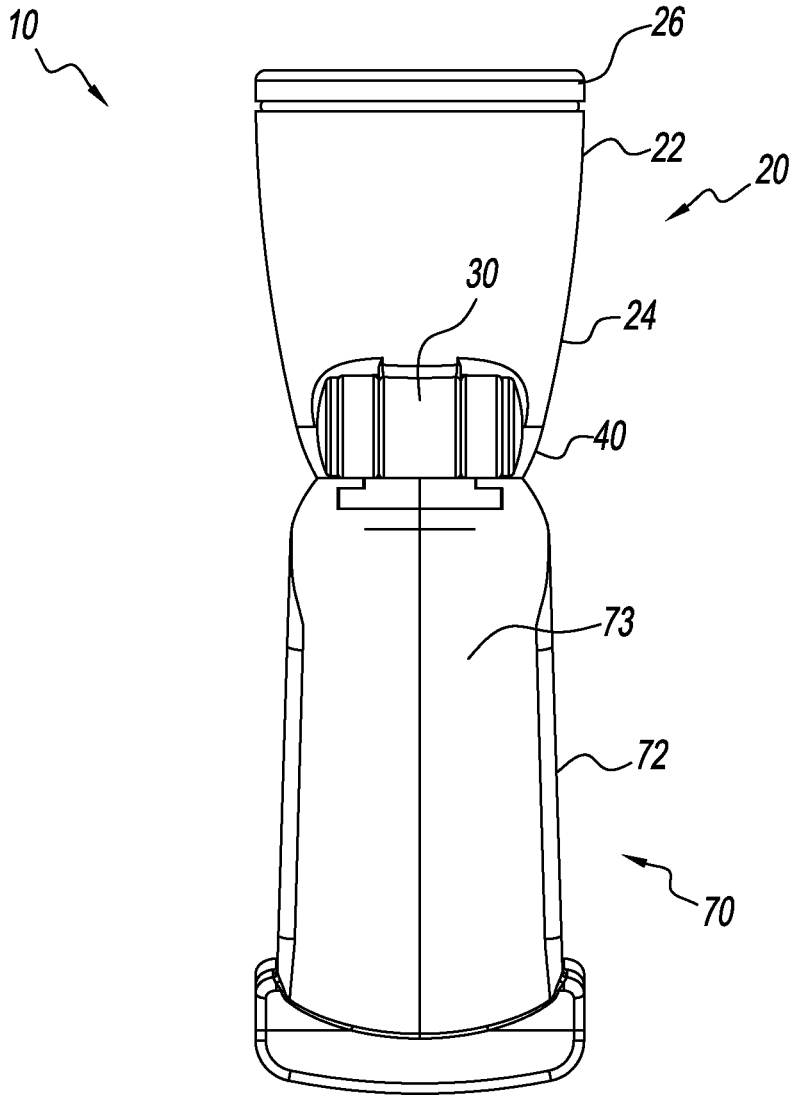
FIG. 6 is a bottom view of the flashlight of FIG. 1.

The terms "top", "bottom", "front", "back", and "side" are merely used for ease of description, and do not impart any specific orientation on the devices of the present disclosure.

DETAILED DESCRIPTION OF THE DISCLOSURE

Referring to FIGS. 1-7, flashlight 10 of the present disclosure is shown. Flashlight 10 has a head 20 and a handle or gripping portion 70. Handle 70 further comprises a main arm 72 and a clip arm 74, which are mounted to each other in such a way as to be biased in a closed position, as shown. Main arm 72 and clip arm 74 can be gripped and squeezed together by a user, such that a gripping portion 76, defined by an end of main arm 72 and an end of clip arm 74, opens, and can be attached to a fixed object. When gripping portion 76 is in its closed position, main arm 72 and clip arm 74 can be easily held by a user, rendering flashlight 10 portable. The term "handle" is used for ease of description, and refers to the portion of light 10 formed by main arm 72 and clip arm 74 which the user can grab or grip to manipulate flashlight 10.

The present disclosure therefore provides a flashlight 10, that a user can use in hands-free operation by attaching it to a fixed object, which still remains portable for the user. Main arm 72 and clip arm 74 define a clip that is integrated into the handle 70, so that handle 70 can double as a grip for the user for portable use, and can also be used to affix flashlight 10 to a stationary object. This is a significant improvement over the flashlights of the prior art, which use cumbersome methods to affix the flashlight to a stationary object, and which are not portable.

For ease of describing flashlight 10, the words "front," "back," "top," and "bottom" will be used from the point of view of a user pointing head 20 at an object, with clip arm 74 on top of main arm 72. These directional terms are used only for describing flashlight 10, and are not meant to limit the interpretation of the features discussed below.

Figure 7:
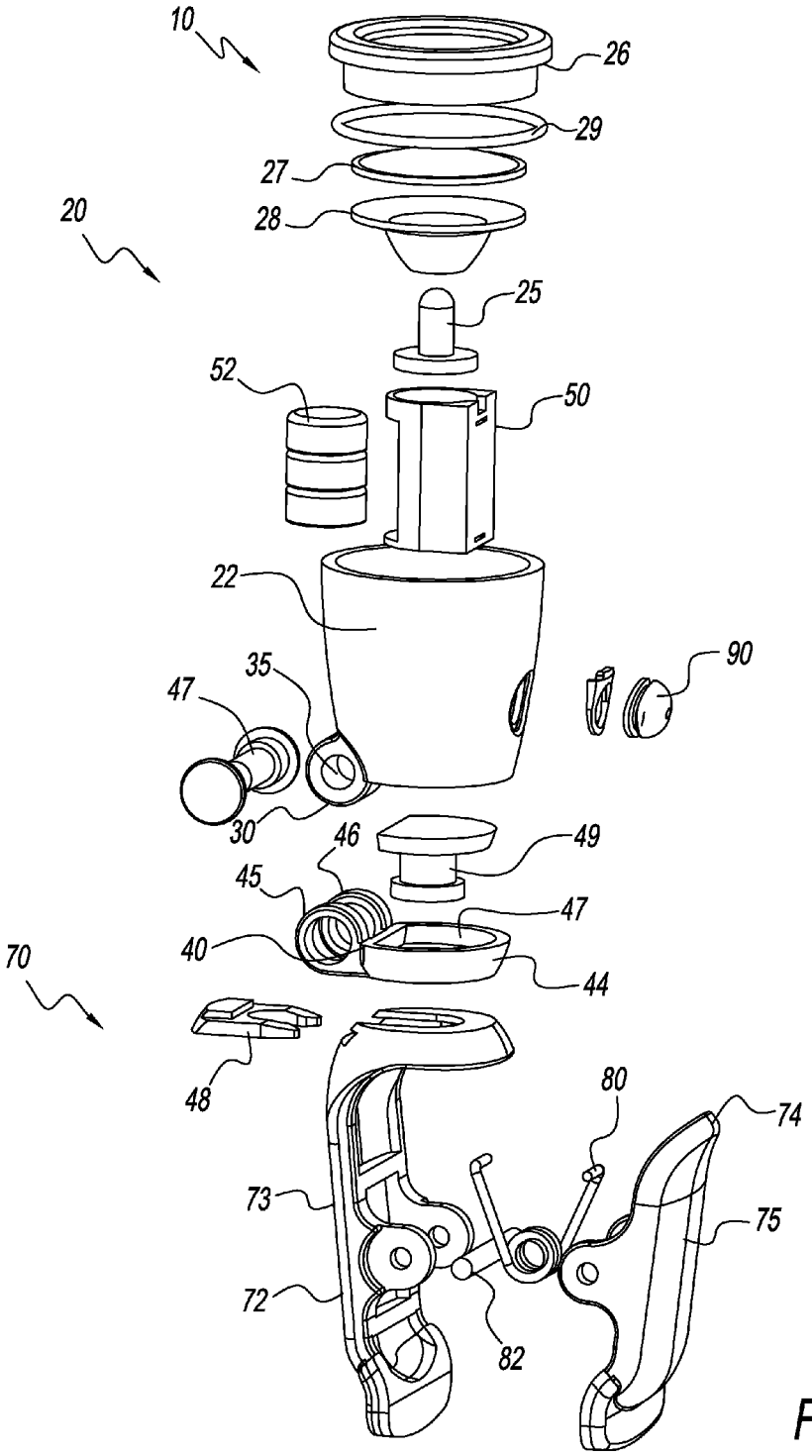
FIG. 7 is an exploded view of the flashlight of FIG. 1

Referring specifically to FIG. 7, an exploded view of flashlight 10 and handle 70 is shown. As previously discussed, main arm 72 and clip arm 74 are biased into a closed position. A spring, actuator, or other device 80 can be placed between main arm 72 and clip arm 74, to create tension between main arm 72 and clip arm 74 and effect the bias. Main arm 72, clip arm 74, and device 80 can be connected to each other with a pivot pin 82 that travels through corresponding holes in main arm 72, clip arm 74, and device 80.

In the shown embodiment, device 80 is a torsion spring. The present disclosure, however, contemplates any devices 80 that can create tension between main arm 72 and clip arm 74, such as tension springs, extension springs, compression springs, integral plastic springs, wire or coil springs, and flat springs. These devices can be positioned around the axis of rotation of clip arm 74, or in another location.

Main arm 72 and clip arm 74 have grip surfaces 73 and 75, respectively. Grip surfaces 73 and 75 can have generally flat profiles, or can also be slightly convex. This allows for easy gripping and manipulation by a user, between either a thumb and forefinger, or with a full hand. Grip surfaces 73 and 75 may also have plastic overmolds thereon (not shown). The interior surfaces of gripping portion 76 may have overmolds as well.

Thus, a user can grasp handle 70, and squeeze a front end of clip arm 74 toward main arm 72, which opens gripping portion 76. Gripping portion 76 can then be affixed to an object, to allow for hands-free operation of flashlight 10. Alternatively, the user can grasp or hold handle 70, and use flashlight 10 in a portable manner. This dual capability of handle 70 provides a convenience not found in the prior art. Currently available flashlights having clamps that can be affixed to objects are not designed for portable use. Currently available flashlights that are portable, however, do not have the ability to be affixed to an object.

Head 20 has body 22 and tapered end 24. Body 22 has a substantially cylindrical profile, and tapered end 24 narrows in the direction of handle 70. Body 22 also has rim 26, lens 27, and reflector 28 connected thereto. A gasket 29 can ensure a tight fit between rim 26 and body 22. When assembled, head 20 has a battery compartment 50 and light source or bulb 25 therein, discussed in greater detail below. These components are concerned with the optics of flashlight 10, and ensure that a proper beam is directed out of head 20. Bulb 25 can be a light-emitting diode (LED).

Body 22 is advantageous in that it is a uniform, one-piece solid body, with the exception of the aperture for button 90 and pivot wheel 30 discussed below. To replace batteries or the light source, a user simply has to remove and replace rim 26 and lens 28, in the manner discussed in greater detail below. The one-piece construction of body 22 also means that is sturdier, more durable, and easier to manufacture than other lights which have multi-component heads or bodies. Some lights, for example, have battery compartments that come out of a side of the head on a tray or similar mechanism. In addition to being harder to manufacture, these devices are more prone to breaking. The tapered cylindrical shape of body 22 also provides an ergonomic design.

Head 20 can also have a button 90 connected to an exterior surface thereof. As shown in FIG. 7, battery housing 50 can store one or more batteries 52. Housing 50 is in electrical communication with button 90 and bulb 25. Button 90 can selectively open and close a circuit between batteries 52 and bulb 25. Thus, a user can turn the light source on and off by pressing button 90. Battery housing 50 is advantageous in that it is compact and fits within head 20. It can easily be removed and replaced simply by removing rim 26.

Body 22 has a pivot wheel 30 connected thereto. Pivot wheel 30 can be a separate component that is connected or fastened to body 22, or can be integrally formed as one component with body 22. Flashlight 10 further has mount 40, to which pivot wheel 30 is operably connected. Mount 40 can have a pivot portion 42, and a rotary portion 44. Pivot portion 42 can have a first loop 45 and a second loop 46. A pivot pin 47 can pass through the open portions of first loop 45 and second loop 46, and also through a hole 35 within pivot wheel 30, thus connecting pivot wheel (and by extension head 20) to mount 40. In this manner, head 20 can rotate about the longitudinal axis of pivot pin 47, in a direction away from, and back toward, rotary portion 44 of mount 40.

In one embodiment, pivot wheel 30 can rotate about pivot portion 42 in the manner described above, and the user can place head 20 in any position along the arc of rotation. A friction fit between pivot wheel 30, first loop 45, and second loop 46 ensures that head 20 stays in the desired position. In another embodiment, pivot wheel 30 can have a plurality of bumps or depressions disposed thereon, which would mate with corresponding structures on pivot wheel 30. In this manner, there can be one or more stops along the arc of rotation of head 20.

Rotary portion 44 of mount 40 can be separately formed from, and connected to, pivot portion 42. Alternatively, the two can be integrally formed as one component. Rotary portion 44 can be rotatably connected to main arm 72 of handle 70, and can rotate about a longitudinal axis of handle 70. As shown in FIG. 7, pin 48 can connect spinning joint 49 to main arm 72. Spinning joint 49 passes through a center hole 47 in rotary portion 44, so that it leaves rotary portion 44 to rotate around joint 49. Similarly to pivot wheel 30, the fit between rotary portion 44, joint 49, and main arm 72 can be such that a friction fit ensures that rotary portion 44 stays in place, or there can be a number of discrete stops along the arc of rotation.

Any of the above described components can be made of materials such as acrylonitrile butadiene styrene (ABS), nylon, or other plastics, or can be made of cast or stamped metal.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure, but that the disclosure will include all embodiments falling within the scope of the claims.

What is claimed is:

1. An illumination device, comprising:

a head comprising a light source, wherein said head comprises a first end and a second end opposite to said first end, and is cylindrically shaped, and wherein a diameter of said head tapers from said first end to said second end, so that a diameter of said head at said second end is less than a diameter of said head at said first end, and said light source projects light out of said first end;

a support member, wherein said head is connected to said support member at said second end;

a clip having one end connected to said support member, and an opposite end having a gripping portion; and a battery compartment within said head, wherein said head rotates with respect to said support member about a first axis, and said clip rotates with respect to said support member about a second axis, and wherein said first axis is traverse to said second axis.

2. The illumination device of claim 1, wherein said clip has a first arm, and a second arm pivotably connected to said first arm.

3. The illumination device of claim 2, wherein said first arm and said second arm are bias mounted to each other, so that said clip is inclined toward a closed position.

4. The illumination device of claim 3, wherein said first arm and said second arm are biased together with a spring.

5. The illumination device of claim 2, wherein at least one of said first arm and said second arm have overmolds disposed on a surface thereon.

6. The illumination device of claim 1, wherein said head further comprises:

a first end;

a second end opposite said first end; and a removable rim connected to said first end, wherein said head is connected to said support member at said second end.

7. An illumination device, comprising:

a head comprising a light-emitting portion and a battery compartment therein, wherein said head comprises a first end a second end opposite said first end;

a handle rotatably connected to said head at said second end; and a removable rim connected to said first end, so that said removable rim selectively opens and closes said battery compartment, and wherein said light-emitting portion projects light through said rim, wherein said handle comprises a clip integrally formed therein, wherein said head rotates with respect to said handle about a first axis, and said handle rotates with respect to said head about a second axis, and wherein said first axis is traverse to said second axis.

8. The illumination device of claim 7, wherein said clip comprises a first arm, and a second arm connected to said first arm.

9. The illumination device of claim 8, wherein said first arm and said second arm are bias mounted to each other, so that said clip is inclined toward a closed position.

10. The illumination device of claim 7, wherein said head is cylindrically shaped, and wherein a diameter of said head tapers from said first end to said second end, so that a diameter of said head at said second end is less than a diameter of said head at said first end, and said light source projects light out of said first end.

11. The illumination device of claim 10, wherein said head is connected to said handle at said second end.

12. The illumination device of claim 2, wherein each of said first arm and said second arm of said clip have grip surfaces that are flat.

13. The illumination device of claim 8, wherein each of said first arm and said second arm of said clip have grip surfaces that are flat.

14. The illumination device of claim 2, wherein each of said first arm and said second arm of said clip have grip surfaces that are curved.

15. The illumination device of claim 8, wherein each of said first arm and said second arm of said clip have grip surfaces that are curved.

16. The illumination device of claim 6, wherein said removable rim selectively opens and closes said battery compartment.

17. The illumination device of claim 1, wherein said first axis is perpendicular to said second axis.

18. The illumination device of claim 7, further comprising a mount, wherein said head is connected to said mount at said second end of said head, and said handle is connected to said mount, wherein said head rotates with respect to said mount about said first axis, and wherein said handle rotates with respect to said mount about said second axis.

19. The illumination device of claim 7, wherein said first axis is perpendicular to said second axis.

* * * * *